US008220378B2

(12) United States Patent
Gamache et al.

(10) Patent No.: US 8,220,378 B2
(45) Date of Patent: Jul. 17, 2012

(54) COMPOSITE ARMOR PANEL AND METHOD OF MANUFACTURING SAME

(75) Inventors: Raymond M. Gamache, King George, VA (US); Irvin Daniel Helton, Des Moines, WA (US); Michael S. Cork, Richardson, TX (US)

(73) Assignees: Specialty Products, Inc., Lakewood, WA (US); The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/157,751

(22) Filed: Jun. 21, 2005

(65) Prior Publication Data

US 2007/0017359 A1 Jan. 25, 2007

(51) Int. Cl.
*F41H 5/02* (2006.01)

(52) U.S. Cl. ..... 89/36.02; 89/36.08

(58) Field of Classification Search ..... 89/36.02, 89/36.05, 36.08, 36.11, 36.01; 109/49.5
See application file for complete search history.

(56) References Cited

U.S. PATENT DOCUMENTS

| | | | | | |
|---|---|---|---|---|---|
| 1,463,498 | A | * | 7/1923 | Burgess | 109/81 |
| 3,431,818 | A | * | 3/1969 | King | 89/36.02 |
| 3,523,057 | A | * | 8/1970 | Buck | 428/156 |
| 3,638,589 | A | * | 2/1972 | Shoop | 109/76 |
| 3,705,558 | A | * | 12/1972 | McDougal et al. | 109/84 |
| 4,179,979 | A | * | 12/1979 | Cook et al. | 89/36.02 |
| 4,979,425 | A | | 12/1990 | Sprague | |
| 5,067,388 | A | | 11/1991 | Crews | |
| 5,110,661 | A | * | 5/1992 | Groves | 428/178 |
| 5,134,725 | A | * | 8/1992 | Yeshurun et al. | 2/2.5 |
| 5,361,678 | A | * | 11/1994 | Roopchand et al. | 89/36.02 |
| 5,364,679 | A | * | 11/1994 | Groves | 428/76 |
| 5,736,474 | A | | 4/1998 | Thomas | |
| 5,738,925 | A | * | 4/1998 | Chaput | 428/101 |
| 5,763,813 | A | | 6/1998 | Cohen et al. | |
| 5,866,839 | A | * | 2/1999 | Ohayon | 89/36.08 |
| 6,112,635 | A | | 9/2000 | Cohen | |
| 6,253,655 | B1 | | 7/2001 | Lyons et al. | |
| 6,289,781 | B1 | * | 9/2001 | Cohen | 89/36.02 |
| 6,408,734 | B1 | * | 6/2002 | Cohen | 89/36.02 |
| 6,575,075 | B2 | | 6/2003 | Cohen | |
| 6,601,497 | B2 | | 8/2003 | Ghiorse et al. | |
| 6,703,104 | B1 | | 3/2004 | Neal | |
| 6,826,996 | B2 | * | 12/2004 | Strait | 89/36.02 |
| 7,117,780 | B2 | * | 10/2006 | Cohen | 89/36.02 |
| 2002/0012768 | A1 | * | 1/2002 | Cohen | 428/117 |
| 2003/0167910 | A1 | | 9/2003 | Strait | |
| 2004/0144244 | A1 | | 7/2004 | Sargent | |

(Continued)

OTHER PUBLICATIONS

ISR—PCT/US2006/29641, Sep. 10, 2008, Specialty Products, Inc.

*Primary Examiner* — Benjamin P Lee
(74) *Attorney, Agent, or Firm* — Scott T. Griggs; Griggs Bergen LLP

(57) ABSTRACT

A composite armor panel and method of manufacturing the same are disclosed. In one embodiment, a plurality of ceramic spheres are positioned in contact with an armor substrate. A polyurea layer is interposed between the plurality of ceramic spheres such that the polyurea layer partially encapsulates the plurality of ceramic spheres and bonds the plurality of ceramic spheres to the armor substrate. The plurality of ceramic spheres are partially exposed and oriented in a direction of anticipated impact.

11 Claims, 4 Drawing Sheets

U.S. PATENT DOCUMENTS

2005/0072294 A1* 4/2005 Cohen ..... 89/36.02
2005/0087064 A1* 4/2005 Cohen ..... 89/36.04
2005/0204696 A1* 9/2005 Hall ..... 52/782.1
2005/0235818 A1 10/2005 Lucuta et al.
2006/0065111 A1* 3/2006 Henry ..... 89/36.02
2006/0105183 A1 5/2006 Chu et al.
2006/0248827 A1* 11/2006 Meeker ..... 52/309.15

* cited by examiner

COMPOSITE ARMOR PANEL AND METHOD OF MANUFACTURING SAME

STATEMENT REGARDING FEDERALLY SPONSORED RESEARCH AND DEVELOPMENT

The U.S. Government has a paid-up license in this invention and the right in limited circumstances to require the patent owner to license others on reasonable terms as provided for by the terms of Contract No. N41756-04-M-4238 awarded by the Department of the Navy.

TECHNICAL FIELD OF THE INVENTION

This invention relates, in general, to military-grade armor panels and methods of manufacturing the same and, in particular, to military-grade composite armor panels that provide for blast and fragment protection from explosive devices as well as ballistic mitigation.

BACKGROUND OF THE INVENTION

In response to ever-increasing anti-armor threats, improvements are warranted in the field of blast and fragment protection from explosive devices as well as ballistic mitigation. In particular, OEM and retrofit armor panels are needed that meet or exceed the protection provided by existing armor panels such as 0.202" High Hard Steel (HHS) panels and ⅜" Rolled Homogeneous Armor (RHA) panels.

SUMMARY OF THE INVENTION

A composite armor panel and method of manufacturing the same are disclosed that provide blast and fragment protection from explosive devices as well as ballistic mitigation. In one embodiment, a plurality of ceramic spheres are positioned in contact with an armor substrate. A polymer layer, which may include a polyurea, polyurethane, or hybrid thereof, for example, is interposed between the plurality of ceramic spheres such that the polymer layer partially or fully encapsulates the plurality of ceramic spheres and bonds the plurality of ceramic spheres to the armor substrate. Depending on the application of the polymer layer, the plurality of ceramic spheres are either partially exposed or completely encapsulated and, in both instances, oriented in a direction of anticipated impact.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
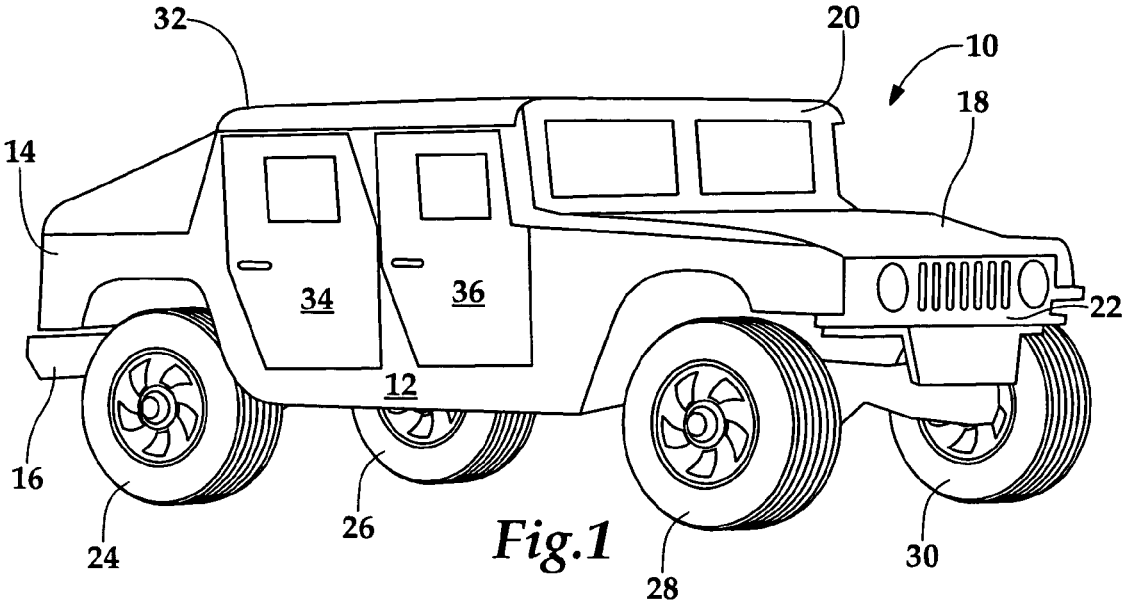
FIG. 1 depicts a front perspective view of one embodiment of a High Mobility Multipurpose Wheeled Vehicle (HMMWV) or Humvee utilizing the composite armor panels presented herein.

Referring initially to FIG. 1, therein is depicted one embodiment of a Humvee, which is utilizing the composite armor panels described herein, that is schematically illustrated and generally designated 10. The Humvee 10 is a light, highly mobile, diesel-powered, four-wheel-drive vehicle equipped with an automatic transmission. Using various common components and kits, the Humvee 10 can be configured as a troop carrier, armament carrier, S250 shelter carrier, ambulance, TOW missile carrier, or a Scout vehicle, for example. It should be understood that the Humvee is presented by way of example only. As will be discussed hereinbelow, the composite armor panels described herein may be utilized with any type of military vehicle, civilian vehicle, or fixed structure.

As illustrated, the Humvee 10 is outfitted as a troop carrier that is extremely effective in difficult terrain regardless of road type or weather conditions. In this configuration, the Humvee 10 is designed to protect the lives of the soldiers being transported as well as the integrity of any onboard cargo. A body tub 12, a bed 14, a rear fender 16, a front hood 18, and a roof 32 are manufactured from aluminum panels which are appropriately bonded and riveted together. Steel components such as a windshield 20 and front grill 22 add further armor and protection. A V8, 6.2 liter displacement, fuel injection engine transfers power to drive axles and onto rear tires 24 and 26 and front tires 28 and 30 which include a runflat system to enable operation even with one or more flat tires.

For additional protection, doors 34 and 36 comprise composite armor panels that provide blast and fragment protection from explosive devices as well as ballistic mitigation. As will be explained in additional detail hereinbelow, the composite armor panels include a substrate having a polymer layer disposed thereon. Ceramic spheres are secured to the substrate by the polymer layer and may or may not be in contact with the substrate. Moreover, the polymer layer may or may not completely encapsulate the ceramic spheres. For additional protection, an armor plate may be integrated into the composite armor panel and positioned in an opposing relationship to the armor substrate by the polymer layer. The composite armor panels described herein impart protection that meets or exceeds that of existing armor panels.

It should be appreciated that although the composite armor panels are described as being utilized in the doors of a Humvee, the composite armor panels described herein may be utilized with other types of vehicles and structures. By way of example, the composite armor panel may form a portion of a tank or a wall of a structure, regardless of whether the structure is permanent or fixed. By way of further example, the composite armor panel may form a portion of a non-military vehicle such as a fuel vessel of a tanker or hull. Further, as will be described in further detail hereinbelow, the composite armor panels presented herein may be offered as either an OEM product or a retrofit.

Figure 2A:
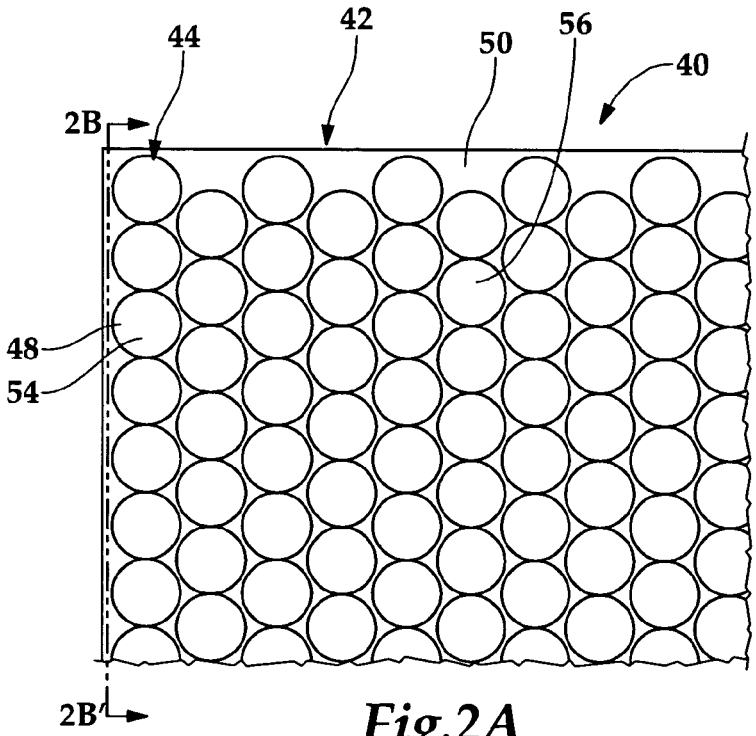
FIG. 2A depicts a front plan view, partially broken away, of one embodiment of a Humvee door having a composite armor panel.
Figure 2B:
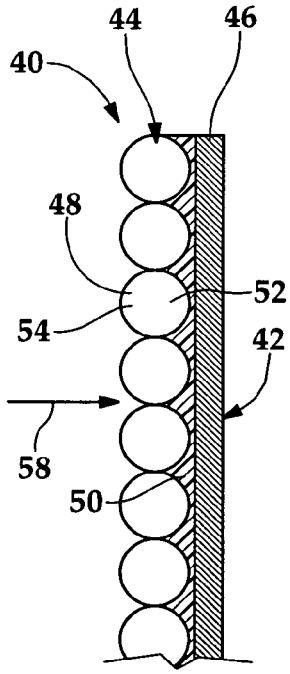
FIG. 2B depicts a side cross-sectional view, partially broken away, of the Humvee door of FIG. 2A taken along line 2B-2B'.

Referring jointly to FIGS. 2A and 2B, one embodiment of a portion of a Humvee door 40 having a composite armor panel 42 is depicted. A layer of ceramic spheres 44 is positioned in contact with a substrate 46. As depicted, the layer of ceramic spheres 44 includes ceramic spheres, such as ceramic sphere 48. A polymer layer 50 is interposed between the ceramic spheres that comprise the layer of ceramic spheres 44. The polymer layer 50 partially encapsulates the layer of ceramic spheres 44 and bonds the layer of ceramic spheres 44 to the substrate 46. The layer of ceramic spheres 44 is partially exposed. By way of example, ceramic sphere 48 includes an encapsulated surface 52 and an exposed surface 54.

In one presently preferred exemplary embodiment, the composite armor panel 42 comprises a single layer or array of ceramic spheres 44 and the ceramic spheres 44 are positioned in contact with each other to provide further support. For example, exterior ceramic sphere 48 is contact with four adjacent ceramic spheres and an interior ceramic sphere 56 is in contact with six adjacent ceramic spheres. In this arrangement, the ceramic spheres are positioned in repeating A and B rows wherein the A row is shifted with respect to the B row by approximately ½ the diameter of a ceramic sphere.

The layer of ceramic spheres 44 is oriented in the direction of anticipated impact as represented by arrow 58. In operation, as will be explained in further detail hereinbelow, the layer of ceramic spheres 44 and the polymer layer 50 act in concert to asymmetrically deform the shape of the of the impacting projectile or fragment and absorb and dissipate the kinetic energy of the deformed impactant, thereby arresting the impactant and maintaining the safety and integrity of the troops and/or cargo being transported.

Figure 3C:
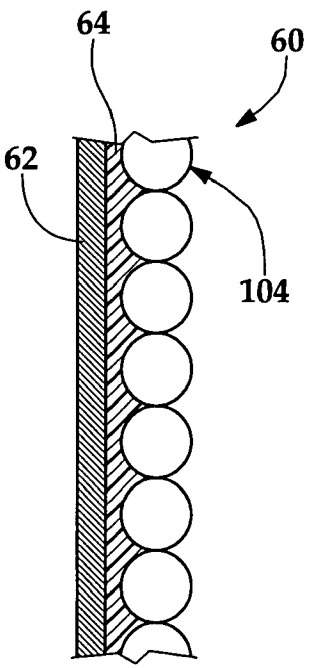
FIGS. 3A through 3C depict three side views illustrating one embodiment of the manufacture of a composite armor panel.
Figure 3B:
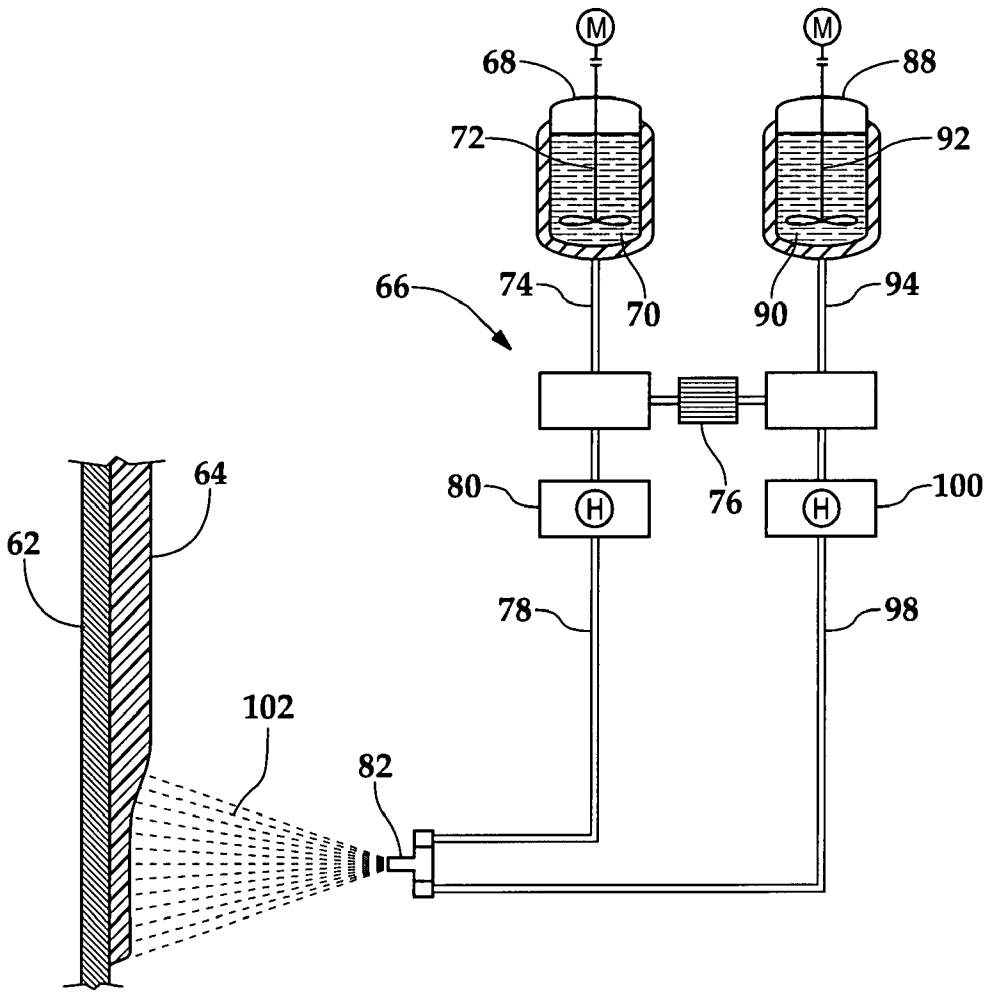
Figure 3A:
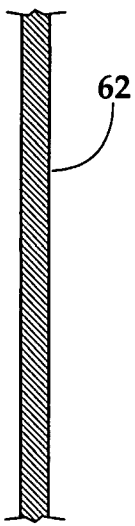

FIGS. 3A through 3C depict one embodiment of the manufacture of a composite armor panel 60 (FIG. 3C). In FIG. 3A, an armor substrate 62 is selected which may be steel, hardened metal, aluminum, HHS, or other material. Preferably, the armor substrate comprises a hardened steel or metal. In one implementation, the armor substrate is between about 0.125" and about 0.4" thick.

In FIG. 3B, plural component spray equipment 66 is utilized to dispose a polymer layer 64 onto the armor substrate 62. Before continuing with the description of FIG. 3B and the plural component spray equipment described hereinbelow, the polymer layer 64 will be described in further detail. The polymer layer may comprise polyurethanes, polyureas, or combinations of elastomeric materials incorporating urethanes, polyureas or hybrids thereof such as acrylics and methacrylates. Preferably, the polymer thermosets and demonstrates medium to high elongation (e.g., 50% to 100%), a medium to high modulus, and high tensile strength.

More preferably, the polymer is a polyurea. By way of example, polyurea elastomers may be derived from the reaction product of an isocyanate (A-side) component and an isocyanate-reactive or resin blend (B-side) component. In another embodiment, the polyurea elastomers may be derived from hybridized isocyanate/resin components. The isocyanate may be aromatic or aliphatic in nature. Additionally, the isocyanate may be a monomer, a polymer, or any variant reaction of isocyanates, quasi-prepolymer or a prepolymer. The prepolymer, or quasi-prepolymer, may comprise an amine-terminated polymer resin, or a hydroxyl terminated polymer resin.

More specifically, the resin blend utilized with the prepolymer or quasi-prepolymer may comprise amine-terminated polymer resins, and/or terminated chain extenders. The resin blend may also contain additives, or non-primary components. For example, the additives may serve cosmetic functions, weight reduction functions, or provide fire-retardant characteristics. By way of further example, these additives may contain hydroxyls, such as pre-dispersed pigments in a polyol carrier.

By way of another example, a polyurethane/polyurea hybrid elastomer may be utilized which is the reaction product of an isocyanate component and a resin blend component. The isocyanate may be aromatic or aliphatic in nature. Further, the isocyanate may be a monomer, a polymer, or any variant reaction of isocyanates, quasi-prepolymers or prepolymers. The prepolymer, or quasi-prepolymer, may comprise an amine-terminated polymer resin, or a hydroxyl-terminated polymer resin. Additionally, the resin blend may comprise blends of amine-terminated and/or hydroxyl-terminated polymer resins, and/or amine-terminated and/or hydroxyl-terminated chain extenders. In one embodiment, the resin blend contains blends of amine-terminated and hydroxyl-terminated moieties. The resin blend may also contain additives, non-primary components or catalysts.

By way of a further example, a polyurethane elastomer may be utilized that is the reaction product of an isocyanate component and a resin blend component. In another embodiment, the polyurethane elastomer is the reaction product of hybridized isocyanate/resins. The isocyanate component may be aromatic or aliphatic in nature. Further, the isocyanate component may be a monomer, polymer, or any variant reaction of isocyanates, quasi-prepolymer, or a prepolymer. The prepolymer, or quasi-prepolymer, may comprise hydroxyl-terminated polymer resins. The resin blend may be made up of hydroxyl-terminated polymer resins, being diol, triol or multi-hydroxyl polyols, and/or aromatic or aliphatic hydroxyl-terminated chain extenders. The resin blend may also contain additives, non-primary components, or catalysts.

Returning to the description of FIG. 3B and the plural component spray equipment 66, as illustrated, the plural component spray equipment 66 includes a chamber 68 for holding a polyisocyanate prepolymer component 70. A mixing element 72 agitates the polyisocyanate prepolymer component 70. A flowline 74 connects the chamber 68 to a proportioner 76 which appropriately meters the polyisocyanate prepolymer component 70 to a heated flowline 78 which is heated by heater 80. The heated polyisocyanate prepolymer component 70 is fed to a mix head 82.

Similarly, a chamber 88 holds an isocyanate-reactive component 90 and a mixing element 92 agitates the isocyanate-reactive component 92. A flowline 94 connects the chamber 88 to the proportioner 76 which, in turn, is connected to a heated flowline 98 having a heater 100. The heated isocyanate-reactive component 90 is provided to the mix head 82 where the polyisocyanate prepolymer component 70 and the isocyanate-reactive component 90 are sprayed as a mixed formulation 102 onto the armor substrate 62. The formulation 102 then begins to cure as the polymer layer 64.

Typically, pressures between about 1,000 psi and about 3,000 psi and temperatures in a range of about 145° F. to about 190° F. (about 63° C. to about 88° C.) are utilized to impingement mix the two components. In other implementations, however, the temperature may be as low as room temperature. Suitable equipment includes GUSMER® H-2000, GUSMER® H-3500, and GUSMER® H-20/35 type proportioning units fitted with either a GUSMER® GX-7, a GUSMER® GX-7 400 series, or a GUSMER® GX-8 impingement mix spray gun (all equipment available from Graco-Gusmer of Lakewood, N.J.). It should be appreciated, however, that the use of plural component spray equipment is not critical to the present invention and is included only as one example of a suitable method for coating the armor substrate. By way of another example, compression molding or injection molding processes, such as reaction injection molding (RIM) processes, may be utilized to manufacture the composite armor panel.

In FIG. 3C, ceramic spheres 104 are potted in the polymer layer 64 prior to the polymer layer 64 completely curing. In this respect, the ceramic spheres 104 and the polymer layer 64 are coplanar. As depicted, the polymer layer 64 is interposed between the armor substrate 62 and the ceramic spheres 104 such that the armor substrate 62 and the ceramic spheres 104 are in a spaced relationship. In one implementation, the ceramic spheres 104 are uniform and exhibit a high degree of symmetry. The ceramic spheres 104 are oriented in the direction of anticipated impact.

Suitable ceramic materials include those having aluminum oxide (alumina or $Al_2O_3$), boron carbide ($B_4C$), boron nitride (BN), silicon carbide (SiC), silicon nitride ($Si_3N_4$), and zirconium oxide (zirconia or $ZrO_2$), for example. Preferably, the ceramic spheres 104 are at least 90% alumina. Regardless of the ceramic material selected, a high hardness is preferable. A Vickers Hardness number of at least 15 is suitable and a Vickers Hardness number of at least 30 is more suitable.

Figure 4C:
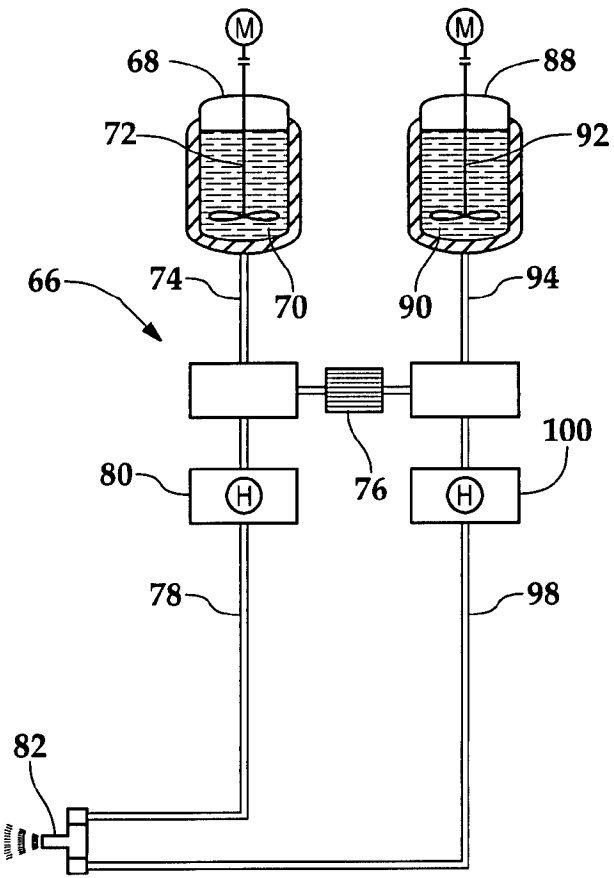
FIGS. 4A through 4C depict three side views illustrating another embodiment of the manufacture of a composite armor panel.
Figure 4B:
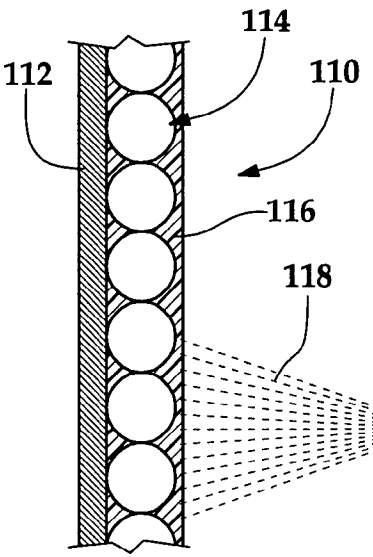
Figure 4B:
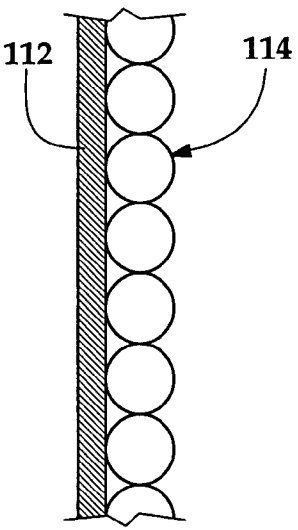
Figure 4A:
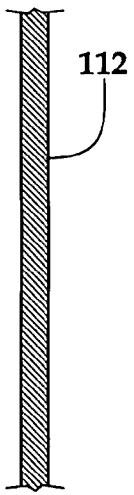

FIGS. 4A through 4C depict another embodiment of the manufacture of a composite armor panel 110 (FIG. 4C) In FIG. 4A, an armor substrate 112 is prepared for a coating treatment. In one implementation, the surface of the armor substrate 112 is sound, dry, clean, and free of surface imperfections such as holes, cracks, and voids. Additionally, the surface of the armor substrate 112 is free of contaminants such as oil, grease, dirt, and mildew, for example. The armor substrate 112 may be pretreated with an acid wash and conditioner or penetrating bonding agent, for example, prior to the application of the polymer.

In FIG. 4B, a layer of ceramic spheres 114 is arranged in a single layer or array on the armor substrate 112. In this embodiment, the layer of ceramic spheres 114 is in contact with the armor substrate 112. In FIG. 4C, plural component spray equipment 66 is utilized to encapsulate the layer of ceramic spheres 114 with a polymer layer 116 and bond the layer of ceramic spheres 114 to the armor substrate 112. As depicted, the ceramic spheres 114 and the polymer layer 116 are oriented in the direction of anticipated impact.

Figure 5A:
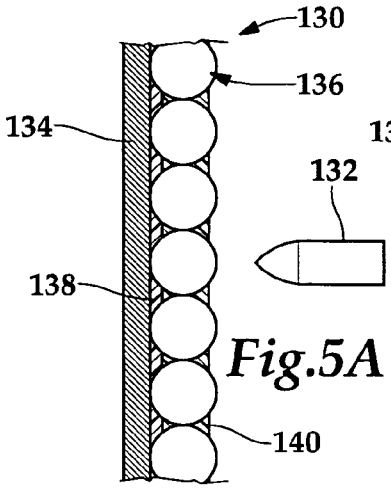
FIGS. 5A through 5C depict three side views of one embodiment of a composite armor panel being impacted by a high-speed, large-caliber projectile.
Figure 5B:
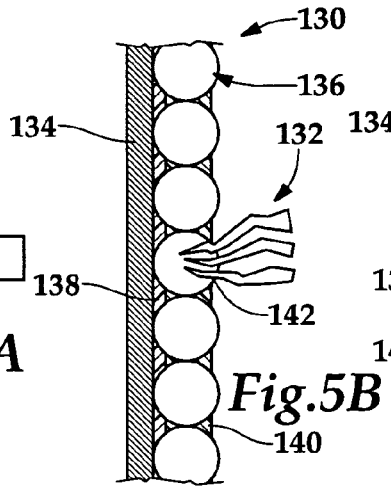
Figure 5C:
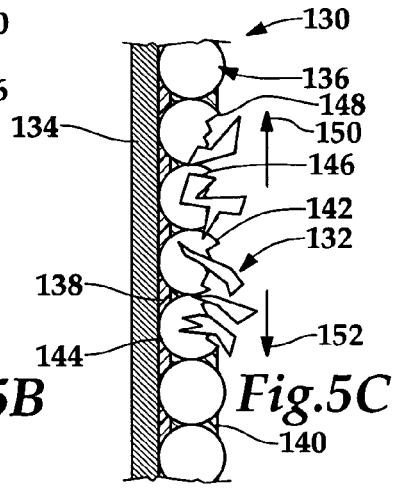

FIGS. 5A through 5C depict one embodiment of a composite armor panel 130 being impacted by a high-speed, high-caliber projectile 132. In FIG. 5A, the composite armor panel 130 includes an armor substrate 134 having a layer of ceramic spheres 136 potted thereto by a polymer 138. Another polymer 140 partially encapsulates the ceramic spheres 136. A combination of two or more polymers may be implemented for a variety of reasons. For example, the polymer 138 may be selected for its ability to bond or pot the ceramic spheres 136 to the armor substrate 134 and the polymer 140 may be selected for its setting properties and inherently high elastic modulus, which as will be discussed in FIG. 3C dissipates a great amount of kinetic energy.

In FIGS. 5A through 5C, the projectile 132 traveling to the composite armor panel 132 is a Fragment Simulating Projectile (FSP). It should be appreciated, however, that the projectile 132 may be a fragment from an Improvised Explosive Device (IED) or armor piercing around from a high-speed, large-caliber firearm, for example. In FIG. 5B, the projectile 132 contacts the composite armor panel 130. More specifically, the projectile 132 initially contacts ceramic sphere 142 which is one of the elements of layer 136. The ceramic sphere 142 introduces deformation into the projectile 132, thereby increasing the footprint of the projectile.

In FIG. 5C, the footprint of the projectile 132 has increased and the projectile is contacting ceramic spheres 142 through 148. Due to the enlarged footprint of the projectile 132, the kinetic energy of the projectile 132 is dissipated at a much greater rate through the composite armor panel 130 in the directions indicated by arrows 150 and 152. Additionally, the inherent elastic modulus of the polymer layers 138 and 140 aids in dissipating the kinetic energy of the projectile 132.

As previously discussed, the composite armor panel taught herein includes a substrate having a layer of ceramic spheres bonded thereto by a polymer layer. The ceramic spheres may or may not be in contact with the substrate. Moreover, the polymer layer may or may not completely encapsulate the ceramic spheres. Additionally, an armor plate may be positioned in an opposing relationship with the armor substrate to add further protection. Also, as previously discussed, the composite armor panels may be OEM offerings or retrofit panels that are bolted or otherwise secured to a preexisting surface. The following four figures, FIGS. 6 through 9, illustrate other embodiments of the present invention that depict various permutations of ceramic sphere placement, encapsulation, and armor plating. It should be understood, however, that other embodiments are within the teachings of the present invention too.

Figure 6:
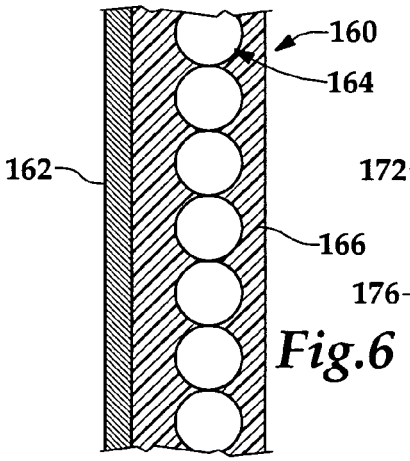
FIG. 6 depicts a side cross-sectional view of another embodiment of a composite armor panel.

FIG. 6 depicts a further embodiment of a composite armor panel 160. An armor substrate 162 has a layer ceramic spheres 164 bonded thereto by a polymer layer 166 which also completely encapsulates the layer of ceramic spheres 164. In this embodiment, the layer of ceramic spheres is spaced or offset from the armor substrate 162 by the polymer layer 166. Additionally, the layer of ceramic spheres 164 and the polymer layer 166 are oriented in the direction of anticipated impact.

Figure 7:
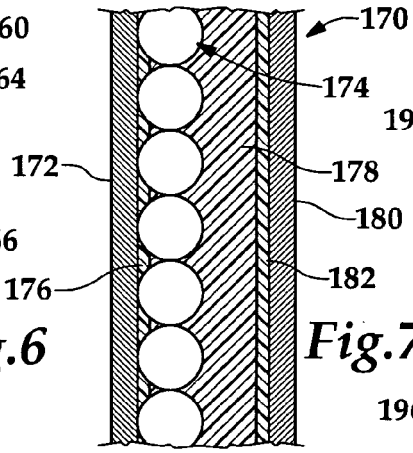
FIG. 7 depicts a side cross-sectional view of another embodiment of a composite armor panel.

FIG. 7 depicts another embodiment of a composite armor panel 170 which includes a substrate and a layer of ceramic spheres 174 that are in contact with the armor substrate 172. A polymer 176 pots the ceramic spheres 174 to the armor substrate 172 and a polymer 178, which may be a setting polymer, encapsulates the layer of ceramic spheres 174. For additional protection, an armor plate 180 forms a part of the composite armor panel 170 and is secured to the polymer layer 178 in an opposing relationship with the armor substrate 172 by a polymer layer 182. It should be appreciated that in particular embodiments, polymer layers 176, 178, and 182 may comprise the same polymer. Similar, to the armor substrate 172, the armor plate 180 may be steel, hardened metal, aluminum, HHS, or other material. Additionally, the layer of armor plate 180 is oriented in the direction of anticipated impact.

Figure 8:
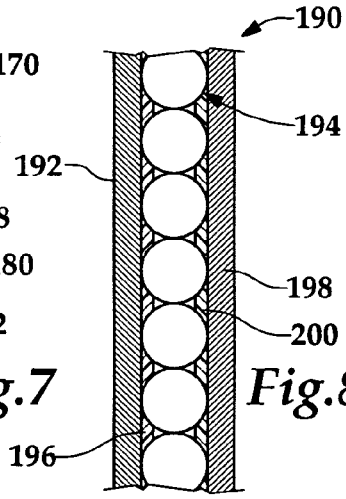
FIG. 8 depicts a side cross-sectional view of another embodiment of a composite armor panel.

FIG. 8 depicts another embodiment of a composite armor panel 190 that has an armor substrate 192 and a layer of ceramic spheres 194 bonded thereto by a polymer layer 196.

The layer of ceramic spheres 194 are in contact with the armor substrate 192. An armor plate 198 is in contact with the layer of ceramic spheres 194 and secured thereto by a polymer layer 200. In this embodiment, small air gaps are left around the layer of ceramic spheres 194 between the polymer layers 196 and 200.

Figure 9:
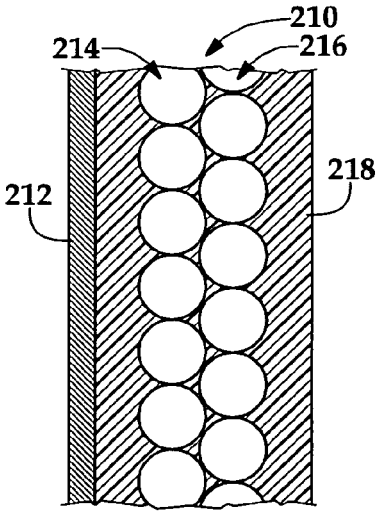
FIG. 9 depicts a side cross-sectional view of another embodiment of a composite armor panel.

FIG. 9 depicts another embodiment of a composite armor panel 210 that has an armor substrate 212 and both a first layer of ceramic spheres 214 and a second layer of ceramic spheres 216. A polymer layer 218 bonds the first layer of ceramic spheres 214 to the armor substrate 212 and the two layers of ceramic spheres 216 and 218 to each other. As illustrated, the ceramic spheres may be arranged in a hexagonal-closed-pack arrangement.

Figure 10A:
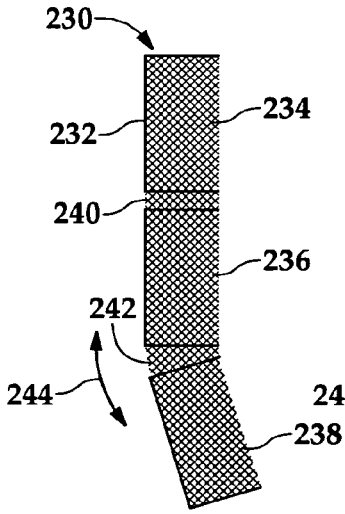
FIG. 10A depicts a side view of one embodiment of an armor panel for personal protection that utilizes composite armor panels.

FIG. 10A depicts one embodiment of armor 230 for personal use which comprises a mesh 232 having composite armor panels 234, 236, and 238 embedded therein. In implementation the mesh 232 comprises a light metal weave or high tensile strength fiber such as KEVLAR®, for example. The composite armor panels 234, 236, and 238 are spaced apart within the mesh 232, thereby creating articulated portions 240 and 242 therebetween. As indicated by arrow 244, each articulated portion affords the personal armor 230 flexibility and the ability to conform to the shape of the wearer, for example.

Figure 10B:
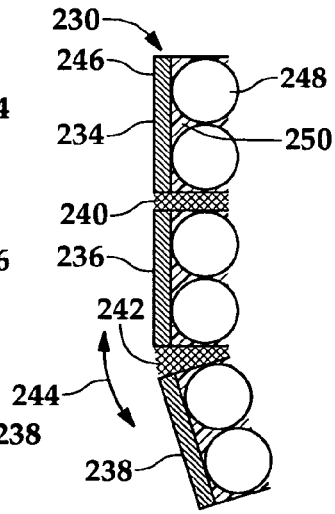
FIG. 10B depicts a side cross-sectional view of the armor panel presented in FIG. 10A.

FIG. 10B depicts a side cross-sectional view of the armor 230 presented in FIG. 10A in order to better illustrate the composite armor panels 234, 236, and 238 embedded within the mesh 232. For purposes of explanation, the structure of the composite armor panels 234, 236, and 238 will be described with reference to composite armor panel 234. An armor substrate has ceramic spheres 248 and 250 mounted thereto by a polymer 252. In one implementation, the composite armor panel 234 includes a small single layer array of ceramic spheres. For example, the array may range in size from 1×1 to 2×2. By minimizing the size of the array, the number of embedded composite armor panels and articulated portions are maximized to provide suitable flexibility. Additionally, minimizing the diameter of the ceramic spheres reduces the encumbrance of the armor and increases the wearability. Ceramic spheres having a diameter of less than approximately ¼" are suitable for the personal use armor described herein.

The present invention will now be illustrated by reference to the following non-limiting working examples wherein procedures and materials are solely representative of those which can be employed, and are not exhaustive of those available and operative.

Example 1

A 0.202" HHS armor substrate was selected and polyurea/polyurethane plural component coating (by way of example, such coatings are available from Speciality Products, Inc. of Lakewood, Wash.) was applied at a thickness of approximately 0.5" with GUSMER® spray equipment (available from Graco-Gusmer of Lakewood, N.J.). Prior to the coating curing, 1" diameter alumina spheres were potted in the polymer in contact with the 0.202" HHS armor substrate. The composite armor panel was then permitted to complete curing.

Example 2-11

The composite armor panels of Examples 2-11 were prepared substantially according to the procedures presented in Example I with the components noted in Table II. For purposes of comparison, the components of Example 1 are also presented in Table I.

TABLE I

Design of Composite Armor Panels

| Composite Armor Panel | Substrate | Ceramic sphere | Polymer Layer |
|---|---|---|---|
| Example 1 | 0.202" HHS | 1" $Al_2O_3$ Spheres | SPI Polyurea |
| Example 2 | 0.25" Steel | 1" $Al_2O_3$ Spheres | SPI Polyurea |
| Example 3 | 0.375" Al | 1" $Al_2O_3$ Spheres | SPI Polyurea |
| Example 4 | 0.202" HHS | ¾" $Al_2O_3$ Spheres | SPI Polyurea |
| Example 5 | 0.25" Steel | ¾" $Al_2O_3$ Spheres | SPI Polyurea |
| Example 6 | 0.375" Al | ¾" $Al_2O_3$ Spheres | SPI Polyurea |
| Example 7 | 0.202" HHS | ½" $Al_2O_3$ Spheres | SPI Polyurea |
| Example 8 | 0.25" Steel | ½" $Al_2O_3$ Spheres | SPI Polyurea |
| Example 9 | 0.375" Al | ½" $Al_2O_3$ Spheres | SPI Polyurea |
| Example 10 | 0.202" HHS | ⅜" $Al_2O_3$ Spheres | SPI Polyurea |
| Example 11 | 0.202" HHS | ½" SiC Spheres | SPI Polyurea |

V-50 Ballistic Limit Testing Methodology. Velocity-50% or V-50 ballistic limit testing is a statistical test developed by the United States Department of Defense that is often used as a design tool by manufacturers during the development and assessment of new armor designs. The V-50 test identifies the theoretical velocity at which a specific projectile has a 50% probability of either penetrating or being stopped by an Armor Under Test (AUT). To compute the velocity, testers fire enough projectiles at the AUT at various velocities to obtain equal groups of non-penetrating and penetrating impacts within a predetermined velocity range which is typically less than 50 feet/second. The V-50 ballistic limit is calculated as the average velocity of the projectiles. Thus, the V-50 covers the identification, within statistical reason, of the velocity at which the AUT stops the projectile 50% of the time.

Table II depicts the V-50 test results for various AUTs using 20 mm 830 grain FSP rounds fired at approximately 50 meters from a smooth bore Mann barrel while varying the striking velocity.

TABLE II

V-50 Test Results

| Armor Under Test (AUT) | V-50 (feet/second) |
|---|---|
| Ex. 1 Composite Armor | >2,500 |
| Ex. 2 Composite Armor | >2,500 |
| Ex. 3 Composite Armor | >2,000 |
| Ex. 4 Composite Armor | >2,000 |
| Ex. 5 Composite Armor | >2,000 |
| Ex. 6 Composite Armor | >1,500 |
| Ex. 7 Composite Armor | >2,000 |
| Ex. 8 Composite Armor | >1,500 |
| Ex. 9 Composite Armor | >1,500 |
| Ex. 10 Composite Armor | >1,500 |
| Ex. 11 Composite Armor | >1,500 |

Ballistic Penetration Testing Methodology. Ballistic penetration testing is a pass/fail test that is used as a design tool by manufacturers during the development and assessment of new armor designs. The ballistic penetration test assesses AUTs under sustained, high-speed, large-caliber fire.

Table III depicts the ballistic penetration results for various AUTs using 7.62 mm rounds fired from a Pulemyot Kalashnikov (PK) general-purpose, gas-operated, belt-fed, sustained fire machine gun. Four shots with less than a 4" spread were fired at 50 meters into the AUTs and ballistic penetration results were noted.

TABLE III

| Ballistic Penetration Test Results | |
|---|---|
| Armor Under Test (AUT) | Penetration Prevented |
| Ex. 1 Composite Armor | YES |
| Ex. 2 Composite Armor | YES |
| Ex. 4 Composite Armor | YES |
| Ex. 5 Composite Armor | YES |
| Ex. 6 Composite Armor | YES |
| Ex. 10 Composite Armor | YES |

The V-50 ballistic limit and ballistic penetration testing methodologies and results presented above demonstrate that the composite armor panel presented herein provides blast attenuation from fragments and ballistic mitigation from high-speed, high-caliber firearms. The protection afforded by the composite armor panel exceeds the protection provided by ⅜" RHA as presented in the Department of Defense Specification MIL-A-12560 which discusses armor plate, steel, wrought, homogeneous materials for use in combat-vehicles and for ammunition testing. The composite armor panels described herein provide this level of protection without the weight and encumbrance associated with ⅜" RHA.

Further, based on the V-50 ballistic limit and ballistic penetration testing methodologies and results, ballistic resistance performance increases as the size of the ceramic sphere increases. Additionally, the highest performing substrate was the 0.202" HHS.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A composite armor panel, comprising:

an armor substrate selected from the group consisting of steel, hardened metal, aluminum, and high hard steel;

a single layer array including a plurality of coplanar ceramic spheres positioned in contact with the armor substrate, each interior ceramic sphere of the plurality of ceramic spheres having ceramic-to-ceramic contact with six other ceramic spheres and ceramic-to-armor substrate contact with the armor substrate and each exterior ceramic sphere of the plurality of ceramic spheres having ceramic-to-armor substrate contact with the armor substrate;

a polyurea polymer layer interposed between the plurality of ceramic spheres, the polyurea polymer layer fully encapsulating the plurality of coplanar ceramic spheres and bonding the plurality of coplanar ceramic spheres to the armor substrate such that the plurality of coplanar ceramic spheres of the single layer array are oriented in a direction of anticipated impact, the respective ceramic surfaces being concealed;

structural support of the composite armor panel consisting of the armor substrate, the single layer array including a plurality of coplanar ceramic spheres, and the polyurea polymer layer; and the coplanar positioning of the single layer array of the plurality of coplanar ceramic spheres and the polymer layer in combination with the polymer layer encapsulation of the ceramic spheres provides ballistic mitigation and resistance equivalent to at least 1.0 inch of wrought-steel homogeneous armor platting such that mitigation and resistance to 20 mm projectiles is achieved.

2. The composite armor panel as recited in claim 1, wherein the armor substrate has a thickness from about 0.125" to about 0.4".

3. The composite armor panel as recited in claim 1, the single layer array including the plurality of coplanar ceramic spheres further comprises A and B rows, the A rows being shifted with respect to the B rows by approximately ½ the diameter of a ceramic sphere.

4. The composite armor panel as recited in claim 1, wherein the plurality of ceramic spheres comprise a material selected from the group consisting of aluminum oxide (alumina or $Al_2O_3$), boron carbide ($B_4C$), boron nitride (BN), silicon carbide (SiC), silicon nitride ($Si_3N_4$), and zirconium oxide (zirconia or $ZrO_2$).

5. A method of manufacturing a composite armor panel, the method comprising:

spraying a polymer onto an armor substrate selected from the group consisting of steel, hardened metal, aluminum, and high hard steel;

potting a single layer array including a plurality of coplanar ceramic spheres in the polymer such that the plurality of coplanar ceramic spheres are fully encapsulated in the polymer and in contact with the armor substrate;

maintaining, during the potting, ceramic-to-ceramic contact for each interior ceramic sphere of the plurality of coplanar ceramic spheres with six other ceramic spheres;

maintaining, during the potting, ceramic-to-armor substrate contact between the plurality of coplanar ceramic spheres and the armor substrate;

permitting the polymer to set;

coplanar-positioning the single layer array of the plurality of coplanar ceramic spheres;

providing the composite armor panel consisting of the armor substrate, the single layer array including a plurality of coplanar ceramic spheres, and the polyurea polymer layer; and creating ballistic mitigation and resistance equivalent to at least 1.0 inch of wrought-steel homogeneous armor platting with the polymer layer in combination with the polymer layer encapsulation of the of ceramic spheres;

achieving mitigation and resistance to 20 mm projectiles; and positioning the armor substrate such that the fully encapsulated ceramic surfaces of the ceramic spheres are oriented in a direction of anticipated impact.

6. The method as recited in claim 5, further comprising:

impacting a projectile onto the composite armor panel;

responsive to projectile and ceramic sphere contact, asymmetrically deforming the projectile; and dispensing the kinetic energy of the deformed projectile through the polymer layer, thereby providing blast and fragment protection.

7. The method as recited in claim 5, further comprising:

impacting a fragment onto the composite armor panel;

responsive to fragment and ceramic sphere contact, asymmetrically deforming the projectile; and dispensing the kinetic energy of the deformed fragment through the polymer layer, thereby providing blast and fragment protection.

8. A composite armor panel, consisting of:

an armor substrate;

a single layer array including a plurality of coplanar ceramic spheres positioned in contact with the armor substrate, each interior ceramic sphere of the plurality of ceramic spheres having ceramic sphere-to-ceramic sphere contact with six other ceramic spheres and ceramic sphere-to-armor substrate contact with the armor substrate and each exterior sphere of the plurality of spheres having ceramic-to-armor substrate contact with the armor substrate; and a polyurea polymer layer interposed between the plurality of ceramic spheres, the polyurea polymer layer fully encapsulating the plurality of coplanar ceramic spheres and bonding the plurality of coplanar ceramic spheres to the armor substrate such that the plurality of coplanar ceramic spheres of the single layer array are oriented in a direction of anticipated impact; and the coplanar positioning of the single layer array of the plurality of coplanar ceramic spheres and the polymer layer in combination with the polymer layer encapsulation of the ceramic spheres provides ballistic mitigation and resistance equivalent to at least 1.0 inch of wrought-steel homogeneous armor platting such that mitigation and resistance to 20 mm projectiles is achieved.

9. The composite armor panel as recited in claim 8, wherein the armor substrate has a thickness from about 0.125" to about 0.4".

10. The composite armor panel as recited in claim 8, the single layer array including the plurality of coplanar ceramic spheres further comprises A and B rows, the A rows being shifted with respect to the B rows by approximately ½ the diameter of a ceramic sphere.

11. The composite armor panel as recited in claim 8, wherein the plurality of ceramic spheres comprise a material selected from the group consisting of aluminum oxide (alumina or $Al_2O_3$), boron carbide ($B_4C$), boron nitride (BN), silicon carbide (SiC), silicon nitride ($Si_3N_4$), and zirconium oxide (zirconia or $ZrO_2$).

* * * * *